US008492685B2

(12) United States Patent
Gutierrez et al.

(10) Patent No.: US 8,492,685 B2
(45) Date of Patent: Jul. 23, 2013

(54) METHOD FOR CONTROLLING A STATIC POWER CONVERSION UNIT AND INDUCTION HEATING SYSTEM FOR COOLING APPLIANCES USING SUCH METHOD

(75) Inventors: Diego Neftali Gutierrez, Varese (IT); Santacatterina Gianpiero, Sangiano (IT); Paderno Jurij, Varedo (IT)

(73) Assignee: Whirlpool Corporation, Benton Harbor, MI (US)

( * ) Notice: Subject to any disclaimer, the term of this patent is extended or adjusted under 35 U.S.C. 154(b) by 535 days.

(21) Appl. No.: 12/574,910

(22) Filed: Oct. 7, 2009

(65) Prior Publication Data

US 2010/0084395 A1 Apr. 8, 2010

(30) Foreign Application Priority Data

Oct. 8, 2008 (EP) ..... 08166091

(51) Int. Cl.

| | |
|---|---|
| ***H05B 6/08*** | (2006.01) |
| ***H05B 6/06*** | (2006.01) |
| ***H05B 6/12*** | (2006.01) |
| ***H05B 1/02*** | (2006.01) |

(52) U.S. Cl.

USPC ..... 219/667; 219/624; 219/661; 219/506

(58) Field of Classification Search

USPC ..... 219/667, 664, 624, 702, 665, 668, 219/626, 506, 661, 625, 621, 442, 620, 660, 219/663

See application file for complete search history.

(56) References Cited

U.S. PATENT DOCUMENTS 3,832,621 A * 8/1974 Kornrumpf et al. ..... 363/37

FOREIGN PATENT DOCUMENTS

| | | | |
|---|---|---|---|
| DE | EP1732357 | * | 5/2006 |
| EP | 1494505 | | 1/2005 |
| EP | 1732357 A2 | | 12/2006 |
| JP | EP0460279 | * | 8/1990 |
| JP | 2001155849 | | 6/2001 |

* cited by examiner

*Primary Examiner* — Chuong A. Luu

(57) ABSTRACT

In a method for controlling a static power conversion unit to an inductor, particularly for an induction system used in cooking appliances, the value of an electrical parameter of the circuit is monitored at predetermined time intervals and at a predetermined duty cycle of the power transistor switching frequency, and on the basis of the monitored value, the duty cycle is modulated accordingly between the predetermined time intervals in order to keep the delivered power at a predetermined constant value.

15 Claims, 2 Drawing Sheets

METHOD FOR CONTROLLING A STATIC POWER CONVERSION UNIT AND INDUCTION HEATING SYSTEM FOR COOLING APPLIANCES USING SUCH METHOD

BACKGROUND OF THE INVENTION

1. Field of the Invention

The present invention relates to a method for controlling the power delivered by a static power conversion unit to an inductor, particularly for an induction heating system used in cooking appliance. The present invention relates as well to an induction heating system, particularly for cooking appliances, adapted to carry out such method.

2. Description of the Related Art

It is well known in the art of induction heating systems used in cooking appliances the importance of controlling the power delivered by the inductor, i.e. the induction coil, in order to adjust the cooking temperature or the cooking utensil heating level at a predetermined level. This is usually obtained by modifying the power transistor switching frequency. For an improved cooking performance it is important to sense the cooking vessel's temperature during the whole process. This information could be used e.g. to control the temperature or to monitor the cooking process phase.

EP-A-1732357 discloses an induction heating device in which the pot's temperature variations are monitored by adjusting the power transistor drive frequency throughout the cooking process in the induction heating. According to such document, during the cooking process the static power conversion unit (converter) operates in two ways: during "heating" intervals it controls the frequency in order to guarantee constant power; during "measurement" intervals, it keeps the frequency to a fixed constant value and measures an electrical parameter correlated to the temperature of the pot bottom.

The above known solution needs that the induction converter changes the frequency of the power transistor drive signal. This requires finding at least two suitable frequencies adapted for the pot load. The choice of the frequencies must be done with special care in order to avoid problem of pan detection (in case one of the frequencies is too high) and/or resonance (coil current might be too big, which is dangerous for the induction power components like the insulated-gate bipolar transistor and which may lead to a failure of the whole induction heating system).

SUMMARY OF THE INVENTION

It is an object of the present invention to provide a control method which overcomes the above drawbacks of the known solutions.

According to the invention, such object is reached thanks to the features listed in the appended claims.

The basic idea underlying the present invention is to avoid the above problems by acting directly on the duty cycle value. In this case the frequency remains always the same, the control of power and the measurement of the induction converter electrical parameter are accomplished with a pulse-width modulation (PWM) methodology by varying the duty cycle of the power transistor drive signals, with the final object of monitoring the temperature of the cooking vessel.

This minimizes the risk of changing the frequency continuously, since the selection of the frequency is done at the beginning of the control algorithm.

BRIEF DESCRIPTION OF THE DRAWINGS

Further features and advantages of a method and of an induction heating system according to the present invention will be clear from the following detailed description, with reference to the attached drawings, in which.

DETAILED DESCRIPTION OF THE PREFERRED EMBODIMENTS

According to a preferred embodiment of the invention, throughout the cooking process the controller doesn't change the frequency, rather the duty cycle only. During the "measurement" intervals $\Delta t_1$ (FIG. 2) it adjusts the duty cycle value to a fixed one, and during the "heating" intervals $\Delta t_2$ it controls and modulates the duty cycle value so as to keep constant the output power.

At the "measurement" intervals $\Delta t_1$ the control measures at least one electrical parameter that depends on the power transistor switching frequency and the duty cycle (both constant between different $\Delta_1$), as well on the pot bottom temperature. This can be e.g. the current flowing through the induction coil, the inductance of the heating system, the voltage supplied to the coil, the converter output active power or a combination thereof. Other electrical parameters can be used as well. At the "heating" intervals $\Delta t_2$, induction converter controls the output power supplied to the pot by modulating the duty cycle and maintaining the frequency constant.

The converter measures the output power supplied to the pot during the "measurement" and "heating" intervals and corrects the duty cycle in order to guarantee a constant output power throughout the cooking process.

For the description of the invention has been considered an induction heating converter that controls the output power supplied to the pot. However, in the market can be found induction heating converters that control the current that flows through the coil. The invention can be applied also to these converters as well, and the duty cycle is modified during the "heating" time so as to keep constant the coil current amplitude during the whole cooking process.

Figure 2:
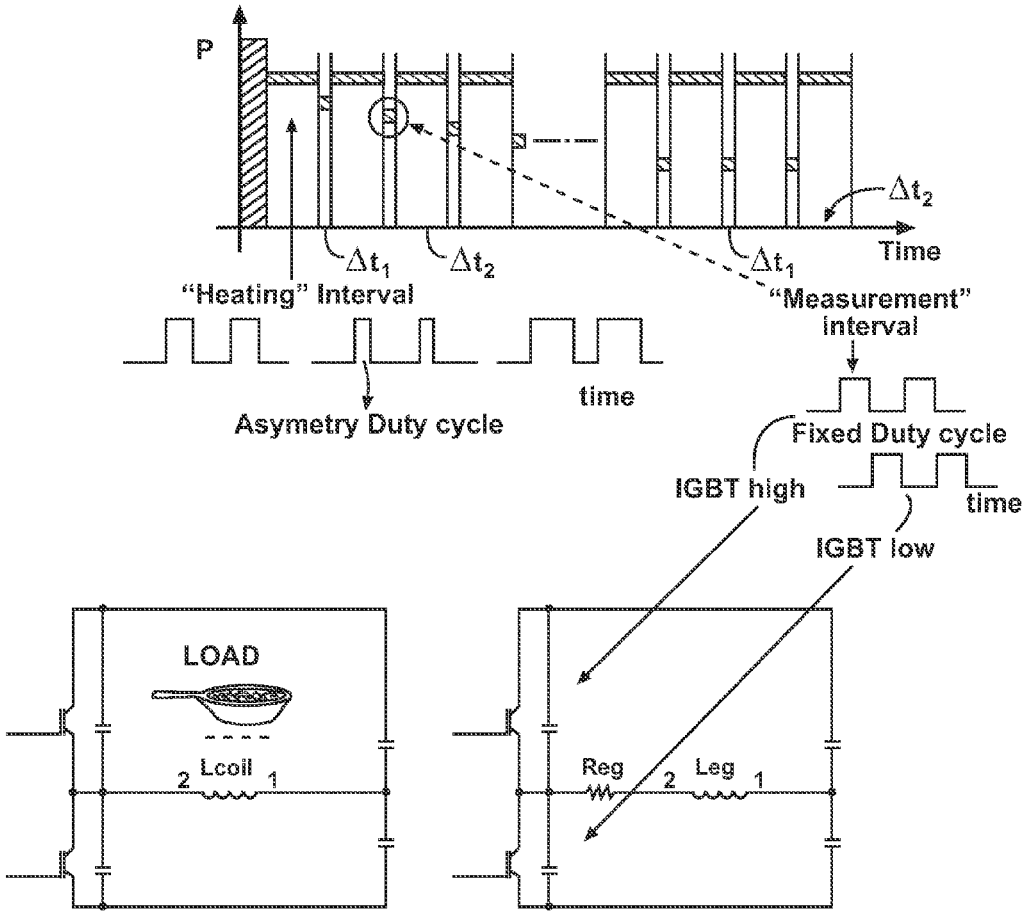
FIG. 2 is a schematic view of a typical topology for the induction heating half bridge series-resonant converter which can be used in the system of FIG. 1, and in which it is shown how the power/temperature control is carried out.

In the upper portion of FIG. 2 it is shown a diagram power vs. time showing how the control of the induction heating converter measures the actual delivered power at "measurement" intervals $\Delta t_1$ with a fixed duty cycle, while it modulates the duty cycle in the "heating" intervals $\Delta t_2$. The bottom part of FIG. 2 shows a typical layout of an half bridge series-resonant converter to which the fixed/modulated pattern of duty cycle according to the invention is applied. Of course other type of resonant converters can be used as well.

Figure 1:
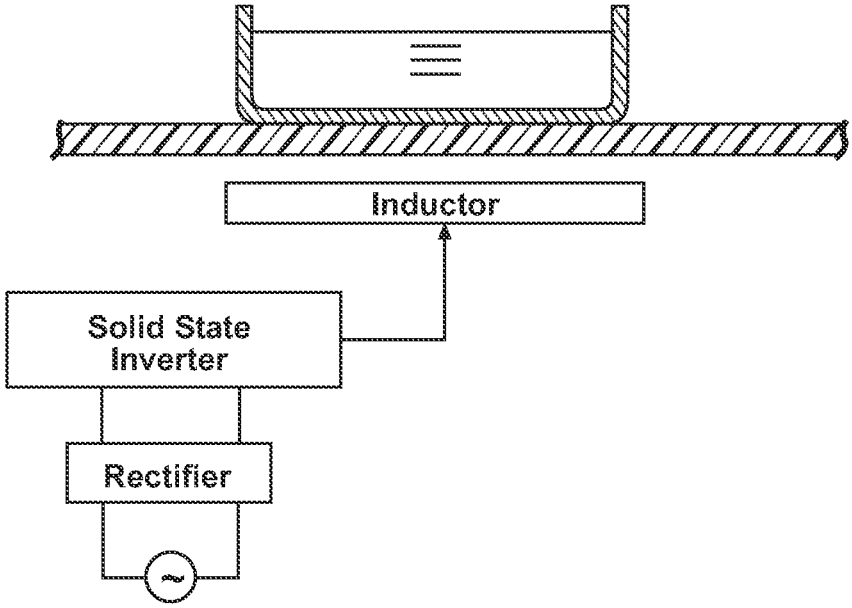
FIG. 1 is a schematic view of an induction heating system used in a cooktop.
Figure 3:
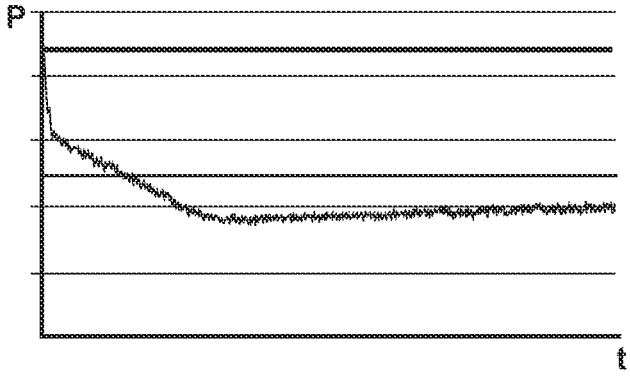
FIG. 3 is a diagram showing the difference between the actual delivered power vs. time and the power measured during the "measurement" intervals.

FIG. 3 shows an example of a cooking process: the upper line in the power vs. time diagram represents the total output power measured at converter, taking into consideration both "measurement" intervals $\Delta t_1$ and "heating" $\Delta t_2$ intervals (it is the actual average power supplied to the pot). The lower line in the diagram represents the output power measured during the "measurement" intervals $\Delta t_1$. It shows the inverse relationship with the temperature of the pot bottom.

According to a second embodiment of the invention, the technical solution of applying variable asymmetry duty cycles can be combined with a control that uses "n" different power transistor drive signal frequencies.

Figure 4:
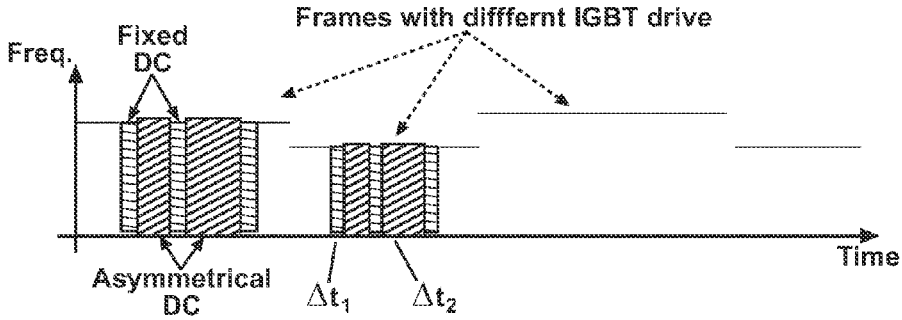
FIG. 4 is a diagram showing a further embodiment of the invention.

In FIG. 4 it is shown an asymmetrical duty cycle control applied within several "frames" of n-different frequencies of power transistor drive signal.

The advantages of combining modulated asymmetrical duty cycles together with different frequencies "frames" is mainly to increase the robustness of the pot temperature estimation, since it increases the correlation data between the electrical parameter and the pot bottom temperature at different duty cycles and frequencies.

Also, this embodiment would increase the compatibility between the asymmetrical duty cycle and the present standard power/current closed-loop control that changes the power transistor frequency vs. time.

Figure 5:
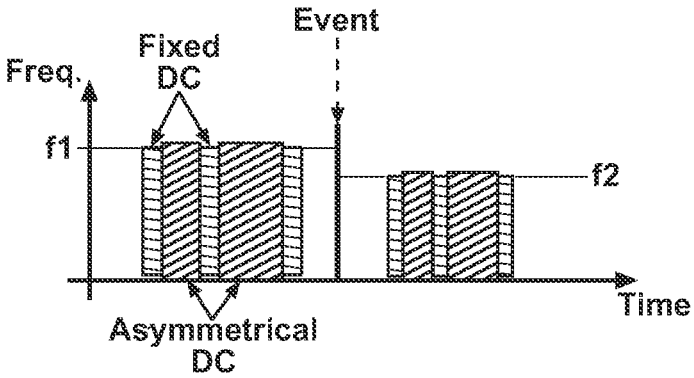
FIG. 5 is a diagram similar to FIG. 4 in which the frequency value is changed due to a certain event.

In FIG. 5 it is shown an asymmetrical duty cycle control that changes the constant frequency value due to internal or external event that changes the working conditions and prevent the induction heating converter from working in non-optimal conditions for monitoring the pot temperature. For instance, an internal event might be variation of the control set point due to temperature derating of critical hardware component. An external event might be displacement of the pot placed by the user onto the hob.

We claim:

1. A method for controlling a static power conversion unit delivering power to an inductor for an induction system used in cooking appliances, the method comprising:

monitoring a value of an electrical parameter of a circuit at predetermined time intervals and at a predetermined duty cycle of a power transistor;

modulating the duty cycle, based on the value, between the predetermined time intervals in order to keep the power at a predetermined constant value; and changing a drive frequency of the power transistor during operation of the inductor according to a predetermined time pattern.

2. The method according to claim 1, wherein the electrical parameter is dependent on temperature.

3. The method according to claim 1, wherein changing the frequency during a cooking process prevents a non-optimal working condition or occurs as a consequence of a detected external event.

4. The method according to claim 1, wherein changing the drive frequency occurs at predetermined times which encompass several predetermined time intervals.

5. The method according to claim 1, wherein modulating the duty cycle of the power transistor drive frequency keeps constant a current that flows through an induction coil.

6. An induction heating system, particularly for cooking appliances, comprising:

a power supply unit for delivering power to an inductive coil; and a control unit for controlling the power at a predetermined level, wherein the control unit is adapted to measure a value of an electrical parameter of the power supply unit at predetermined time intervals and at a predetermined duty cycle of a power transistor, the control unit being also being adapted to modulate the duty cycle between the predetermined time intervals in order to keep the power at a predetermined level wherein a drive frequency of the power transistor is changed during a cooking process according to a predetermined time pattern.

7. The induction heating system according to claim 6, wherein the electrical parameter is dependent on temperature.

8. The induction heating system according to claim 6, wherein the drive frequency is changed during the cooking process in order to prevent a non-optimal working condition or as a consequence of a detected event.

9. The induction heating system according to claim 6, wherein the drive frequency is changed at predetermined times which encompass several predetermined time intervals.

10. The induction heating system according to claim 6, wherein the modulation of the duty cycle of the power transistor is done in order to keep a current that flows through the inductive coil constant.

11. A method of controlling a static power conversion unit in an induction heating system having an inductive coil arranged in a cooking appliance to provide for a cooking process, the method comprising:

monitoring at predetermined time intervals a value of an electrical parameter associated with a circuit connecting the static power conversion unit to the inductive coil;

providing power from the static power conversion unit to the inductive coil at a power transistor switching frequency and at a predetermined duty cycle;

modulating the duty cycle based on the value of the electrical parameter between the predetermined time intervals to maintain the power at a predetermined constant value; and varying a power transistor drive frequency during the cooking process.

12. The method according to claim 11, wherein the electrical parameter is dependent on temperature.

13. The method according to claim 11, further comprising changing the power transistor drive frequency during the cooking process according to a predetermined time pattern.

14. The method according to claim 13, further comprising changing the power transistor drive frequency at predetermined times which encompass several predetermined time intervals.

15. The method according to claim 11 further comprising modulating the duty cycle to maintain a constant current through the inductive coil.

* * * * *